US005746910A

United States Patent [19]

Negeri

[11] Patent Number: 5,746,910

[45] Date of Patent: May 5, 1998

[54] FROTHLESS FLOTATION APPARATUS

[75] Inventor: Tesfaye Negeri, Ottawa, Canada

[73] Assignee: Her Majesty The Queen in right of Canada, as represented by the Minister of Natural Resources, Canada

[21] Appl. No.: 610,876

[22] Filed: Mar. 5, 1996

[51] Int. Cl.[6] ..... B03D 1/24

[52] U.S. Cl. ..... 209/168; 209/170

[58] Field of Search ..... 209/168, 169, 209/170

[56] References Cited

U.S. PATENT DOCUMENTS

| | | |
|---|---|---|
| 2,758,714 | 8/1956 | Hollingsworth . |
| 3,371,779 | 3/1968 | Hollingsworth et al. . |
| 3,393,803 | 7/1968 | Daman . |
| 4,592,834 | 6/1986 | Yang . |
| 4,804,460 | 2/1989 | Moys . |
| 4,822,493 | 4/1989 | Barbery . |
| 4,938,865 | 7/1990 | Jameson . |
| 4,940,534 | 7/1990 | Harrison . |
| 5,122,261 | 6/1992 | Hollingsworth . |
| 5,167,798 | 12/1992 | Yoon et al. . |
| 5,251,764 | 10/1993 | Niitti . |
| 5,294,003 | 3/1994 | Hollingsworth . |
| 5,397,001 | 3/1995 | Yoon . |

FOREIGN PATENT DOCUMENTS

93/20945 10/1993 WIPO .

OTHER PUBLICATIONS

T. Cienski et al., "Zero–Froth Column As Applied To Roughing And Scavenging Flotation", Proceedings, 25th Annual Canadian Memorial Processors Meeting, Jan. 19, 1993.

Finch, J.A. and Dobby, G.S., 1990, "Column Flotation," Pergamon Press.

Soto, H. and Barbary, G., 1991, "Flotation of Coarse Particles in a Counter Current Column Cell," Minerals and Metallurgical Processing, pp. 16–21.

Soto, H.S., 1989, "Column Flotation with Negative Bias, Processing of Complex Ores," Proceedings of the Internation Symposium on Processing of Complex Ores, Halifax, Editors G.S. Dobby and S.A. Rao, pp. 379–385.

Spears, D.R., and Jordan, C.E., 1991, "A Novel Rapid Flotation System Based on the Air–Injected Hydorcyclone," Preprint No. 91–84, Society of Mining Metallurgy and Exploration, Inc.

Suttill, K.R., 1990, "Why are we Content with Ninety Percent," Engineering & Mining Journal, Nov. 1990, pp. 26–29.

*Primary Examiner*—Thomas M. Lithgow
*Attorney, Agent, or Firm*—Jones, Tullar & Cooper, P.C.

[57] ABSTRACT

A novel apparatus for use in frothless flotation. The apparatus includes a cover which is sealingly engaged to the top of the flotation column and a wash-water tank in communication with the upper part of the flotation column wherein the level in the wash-water tank is maintained at or above the level of the cover thereby preventing the formation of a froth layer in the column. The apparatus is adapted to recycle the pulp and the tails. Gas is introduced to the feed and/or recycled tails in motionless mixers. Bubble-pulp separators are provided which recirculate pulp to enhance the quality of the yield.

14 Claims, 11 Drawing Sheets

FROTHLESS FLOTATION APPARATUS

BACKGROUND OF THE INVENTION

1. Field of the Invention

The present invention relates to a flotation process for concentrating mineral ores. Flotation is the most efficient and preferred solid-solid separation method in mineral processing. However, enhanced production of high-grade concentrates at sufficiently high recovery still poses technological challenges. A novel flotation method has been developed to produce final-grade concentrates from finely-ground ores in a single step. In all the cases studied, superior concentrate grades and recoveries were obtained. Furthermore, concentrate production rates, at similar recoveries, are faster than for the conventional rougher, scavenger cleaner configuration.

2. Prior Art

Introduction

The complexity of the physico-chemical phenomena that play a part in flotation is probably unequalled in any other metallurgical field. Flotation machines manufactured to effect flotation, therefore, cannot be expected to be simple in their design or operations. They operate under several incompatible requirements and treat more complicated systems than those handled by other machines. For instance, mixing in the froth phase is detrimental to the process while vigorous mixing is a requirement for bubble-particle collision and attachment, a sub-process that determines the success of flotation. There is a growing demand in the mineral industry for a high-capacity process which can produce a high-grade concentrate at a high recovery and selectivity from low grade complex ores. Although currently not efficient in responding to this ambitious demand, flotation will remain the dominant process. Theoretically it is a very efficient physico-chemical process. Exploitation of the process to the maximum of its capability is hindered partly by equipment design. However, the main hindrance is the fragility and complexity of the froth phase, and the factors effecting the micro and macro processes taking place within the froth such as drainage, bubble coalescence, froth stability, froth structure, local overload, entrainment, froth removal technique, etc.

The efficiency of a flotation machine can be defined accurately only with respect to one particular aspect of the process. The efficiency of a flotation cell may be determined in terms of: (1) its ability to reduce air to small bubbles; (2) its ability to keep sand suspended, (3) its capacity to float so many tons of mineral per hour or to make a clean separation, (4) its ability to float large particles (or fine particles, depending on the particular requirement) of ore; or (5) by the power required to treat a tonne of ore. The selection of flotation equipment based on its efficiency depends, therefore, on each specific situation. Nevertheless, the ideal flotation machine is one that is designed to perform efficiently in many aspects of the process by allowing a wide range of control strategies. This calls for a machine that when required to make better grade, increase throughput, or improve selectivity, can be controlled precisely to meet these requirements without modification. Various flotation procedures have been suggested requiring modifications to the pulp feed locations, to the mechanisms of concentrate removal or pulp suspension. Consequently, there is a wide range of cell designs from which to choose. Flotation circuits consisting of cells of a single design may not perform as well as those circuits consisting of various designs with respect to grade, recovery and/or selectivity..

That is why it is common to find flotation plants using machines of different manufacturers' designs in separate flotation banks.

There are two categories of flotation cells that dominate the mineral processing industry: the column cell and the pneumatic and sub-aeration-type mechanically agitated cell. The first type is usually a high grade/low recovery/low capacity machine (conventional column, packed column, and Jameson cell) while the second type is as high recovery/low grade/high capacity type (e.g. Outokumpu HG cell). The general practice is to use mechanical cells in the rougher scavenger segment of flotation circuits with columns in the cleaner circuits. However, in those cases where gangue mineral particle is recovered by conditions other than entrainment, there is no practical advantage in using columns instead of mechanical cells. The fundamental requirement for the recovery of minerals and the subsequent cleaning of the concentrates by flotation is, therefore, to provide the best possible chemical conditions. Even if all the chemical conditions are perfect, if there is no proper means of forming and manipulating a mineralized froth phase, flotation cannot be made efficient.

Since the invention of the froth flotation process, at the turn of the century, flotation cells have undergone many changes. None of those changes has been fundamental in that the ultimate function of all cells remained the same, viz.: to form and remove mineralized froth in almost the same manner. They all have similar limitations imposed by the coexistence of two mutually dependent phases: pulp and froth, both very sensitive to various operating conditions. The sub-processes taking place in the two phases have different, and often opposite responses to changes made in factors affecting either of the phases. This impossibility of controlling either phase in isolation limits the efficiency of process control in flotation. The composition of the mineral load of the froth phase, the structure of the froth, its stability, carrying capacity, depth, and removal mechanism, all of which are influenced by myriad of process factors, determine the mineral recovery, concentrate grade, selectivity and production rate.

To provide the rationale for the need to develop a new flotation cell and to explain the functions of various components of the cell being proposed to enhance flotation, it is necessary; (a) to give a brief insight into the separate subordinate processes that combine to bring about the formation and recovery of mineralized froth, (b) to critically evaluate the limitations of the current cells in forming and removing mineralized froths at a rate and quality that is; consistent with the new realities of dealing with increasingly low-grade complex ores which require ever finer grinding to liberate mineral grains from the gangue.

To appreciate the benefits of this invention an overview of the current flotation process capability and limitations is outlined Flotation Process Overview Flotation process consists of subordinate sub-processes which are mutually dependent and are affected by operating factors that are mostly interactive.

Subordinate Sub-Processes in Flotation

The three main separate groups of sub-processes are:

(a) processes concerned with mineral separation.

(b) processes affecting floatability and control and, (c) processes related to materials handling and control.

(a) Processes Concerned with Mineral Separation

The separation process consists of chemical treatment of finely-ground ore so that a certain component of it is preferentially made hydrophobic with the common sulphide minerals, the duration and intensity of agitation required to develop hydrophobicity with collectors such as xanthates and dithiophosphates prior to introducing the pulp to flotation is minimal (Arbiter, N and Harris C C, 1962, Flotation Machines, Froth Flotation, AIME, pp347–364). This means, in most cases, the prolongation of flotation time is not so much to attain additional hydrophobicity as to give particles more time to have fruitful encounter with air bubbles to form particle-bubble aggregates. This further implies that under optimized pulp chemistry the flotation rate can be enhanced if such an encounter is accelerated. While current technology allows enhanced particle-bubble attachment by increasing air bubble flow rate, it is at the expense of selectivity and concentrate grade due to the resulting froth phase instability.

(b) Processes Affecting Floatability and Control

Processes that affect floatability and control may have to be examined with respect to the two phases in which they take place.

PULP PHASE

Laskowski, J, 1986, The relationship between floatability and hydrophobicity, Advances in Mineral Processing, pp189–206, in dealing with the relationship between hydrophobicity and floatability, indicated that there are four basic criteria to be satisfied for flotation to occur: (a) the de-wetting of the particle surface (i.e. partial substitution of the water film on particle surface by gas) must be thermodynamically favourable, (b) the particles must collide with a bubble, (c) the disjoining film separating the particle and bubble must thin, rupture and recede within the collision time; and (d) the particle-bubble aggregate formed must be of sufficient strength to withstand shearing forces in the flotation cell. Hydrophobic mineral particles in the flotation pulp must be kept in suspension for as long as it takes for the bubble to encounter the particle and form an aggregate. This is effected mainly by agitating the three-phase slurry (solid/liquid/gas) mechanically in conventional cells, and by allowing the two-phase slurry (solid/liquid) to flow counter-current to the third phase (gas) for a period, determined by the height of the collection zone in the case of column flotation. In either case the collection of the hydrophobic minerals depends on the number of encounters with the bubbles and whether or not there is sufficient time for the particles to bridge the file of viscous slurry that envelops the bubbles.

Whether the bubble-particle encounter results in fruitful mineralization of the bubble or not, the bubble entering the froth phase carries a load of fine particles entrained in the viscous film of water enveloping it. For a given flotation process at equilibrium, the rate of particle collection in any of the manners described is more or less constant, provided that the pulp chemistry and mineralogical composition of the ore has not changed substantially. The particle-collection rate constant is different for different flotation cells, and the cell which most effectively brings bubbles and particles clone enough together for film thinning and bubble rupture to occur should provide the best collection rate. Flotation cells could have been best compared on the basis of this collection rate constant, but the overall flotation rate is not determined solely by the rate at which floatable particles enter the froth phase, but also by the rate at which these particles are transferred from the froth phase to the concentrate.

Froth Phase

Particle-bubble aggregates entering the froth phase are subjected to many micro events which occur within this phase and depend upon the specific cell type. Loaded bubbles arriving at the froth-pulp interface suddenly undergo deceleration which leads to some detachment of the particles (Falutsu M, 1994, Column Flotation froth characteristics-stability of bubble-particle system, International Journal Mineral Processing, (40) pp225–243). Film drainage then occurs, leading to film thinning and eventual bubble coalescence followed by particle detachment. Most of the released particles drop back to the pulp phase since, according to evidence in the literature (Falutsu, 1994, supra), no significant bubble-particle attachment takes place in the froth phase. The dropping back of detached particles may be enhanced by froth washing, as is the case in column flotation. Although it results in higher concentrate grade froth washing works against recovery and flotation rate.

Particle residence times in the froth phase are significant in a plant-scale mechanical cell, and drainage mechanisms in the froth reduces the transfer of this material to the cell froth discharge launder (Cutting, G W, Barber, S P, and Newton, S, 1986, Effects of froth structure and mobility on the performance and simulation of continuously operated flotation cells, International Journal of Mineral Processing, (16) pp43–61). In these cells (normally of rectangular shape), only one lip is associated with froth removal and the time required for froth to move from the back of the cell to this lip is considerably long. The froth residence time in columns can even be longer than in mechanical cells. Froth is a rate-determining factor in all currently-used flotation devices such as mechanical cells and columns (Ross, V E. 1991, A study of the froth phase in large-scale pyrite flotation calls. International Journal Mineral Processing, 30, (1991); Falutsu, 1994, supra). Froth removal mechanisms such as rotating paddles have been also reported to destroy froth structure causing significant drop-back of floatable mineral particles (Moys, H H, 1984, Residence time distribution and mass transport in the froth phase of the flotation process, International Journal Mineral Processing, (13) p117–142). Froth crowding has also a similar effect. This implies that floatation can be substantially enhanced if the froth phase is eliminated altogether, with some provision to clean and transport the concentrate.

Particle surface preparation for flotation is normally completed in the conditioners. It has been shown that bubble-particle attachment and thus a true flotation process depends on whether or not air is able partly to replace water at a collector-conditioned mineral surface. The long residence time normally required in flotation cells is to permit as many particles as possible the opportunity to encounter bubbles having available, free surface area for attachment. This implies that, for properly-hydrophobicized particles in a well-suspended slurry in which air bubbles are sufficiently distributed, the collision probability is the single most important factor in determining the collection rate. However, not every collision results in fruitful bubble-particle aggregation and not all bubbles get the opportunity to come close enough to the hydrophobic mineral particles with their freely accessible surface for attachment. Current flotation equipment have no provision for insuring that all particles, coarse and fine, are brought into intimate contact with suitable numbers of bubbles. Some particles may even exit the cells before the nominal residence time has passed. Very fine particles, due to lack of sufficient inertia, will follow the water stream line and will not form bubble-particle aggregates. These fines, however, can envelop the bubble by occupying the film of water around it. The minerals collected in this manner are mainly gangue and they are removed only through froth washing as in the column flotation. The rate at which the fines drain through washing depends on the thickness of the enveloping film of slurry and increases with the decreasing film thickness (Ross, 1991, supra). In the order of importance, hydrophobic minerals enter the froth zone via three-mechanisms (a) attached to the bubble, (b) entrained in water film and as a component of a slurry (c) entrapped in the space in between touching swarm of bubbles entering the froth. The minerals collected in this manner are mainly gangue and they are removed only through froth washing like in the column flotation. The rate at which the fines drain through washing depends on the thickness of the enveloping film of slurry and increases with the decreasing film thickness (Ross, 1991, supra).

(c) Processes Concerned with Material Handling and Control in Flotation

Froth Handling

Mechanical froth removal by paddles is still being used in many plants. But the simple overflow by displacement is more widely used. Control of froth overflow in mechanical cells is obtained by adjusting the overflow height, by frother-addition rate or by pulp level control (froth depth). Cells with designs for crowding the froth are emerging. Control of flotation process in most plants is based on manipulation of these conditions only. Recent investigations have shown that any form of froth mobility tends to destroy the gains provided by froth separation processes. In recognition of this and other related problems Cutting, Barber and Newton (1986, supra) concluded that if flotation processes are to find wider range of mineral separations then better ways of utilizing froth separation as well as pulp-phase separation must be found. They suggested that either current-style pulp phase mechanisms must be linked with a new froth-removal technology or new pulp and froth phase machines need to be developed.

Process Control (Suttill, K R, Nov. 1990, Why are we content with ninety percent?, E&MJ, 26–29), in his paper stated that flotation is the most enigmatic and difficult mineral processing to control. He also pointed out that the main obstacle to automation, and therefore steadier operation, is insufficient comprehension of the flotation process in the determination of control strategy. Various flotation models have been investigated and reported by many researchers for more phenomenological approach of control. Most of them will have little or no practical applications. In most cases imperfections have shown to limit the predictive utility of flotation models. These imperfections are attributed generally to sub-processes taking place in the froth phase because the factors affecting these sub-processes are not easily quantifiable and change with changing ore composition and particle size distribution of the flotation pulp. Hence they can not be effectively included in model structures. On the other hand, simple mechanistic models having only two parameters have been used with some success to correlate bench-scale data to full-scale plant operations (Laurila, M J, Froth Flotation Modelling, Mar. 1991, Coal, pp50–51). It is the author's belief that had it not been for the requirement for the froth phase and pulp phase to co-exist, phenomenological and mechanistic model based control algorithms would have been successfully utilized. Models would have been less imperfect and even may have included pulp chemistry factors.

A new flotation process has been developed which addresses many of the operating and control problems with current process as described above. The design, operation and control of the flotation cell of the instant invention efficiently:

a. eliminate the recovery of feed water into the concentrate thereby suppressing the recovery of fine gangue mineral particles into the concentrate,
b. reduce the recovery of water into the concentrate to the minimum amount required for concentrate flow,
c. reduce the viscosity of the film around bubbles by providing deep water column through which mineral-laden bubbles freely cruise letting the fine gangue minerals drain from the film without hinderance,
d. eliminate any possibility of short circuiting of particles before being subjected to vigorous interactions With bubbles for attachment,
e. reduces the particle residence time in the flotation system to absolute minimum by eliminating the froth residence time and decreasing the requirement for long residence time in the recovery zone (pulp phase). This is achieved by forcing bubble-particle interaction before feeding to the cell in a manner similar to those described by (Ameluxen, R L, Apr. 1993, The contact cell—a future generation of flotation machines, E&MJ, 36–37).
f. eliminate all the negative aspects of mechanical froth removal techniques

BRIEF DESCRIPTION OF THE DRAWINGS

The present invention will further be described with reference to the accompanying drawings, showing schematic views of flotation cell arrangements; and in which.

BRIEF DESCRIPTION OF THE EQUIPMENT AND OPERATING PRINCIPLES

Figure 1A:
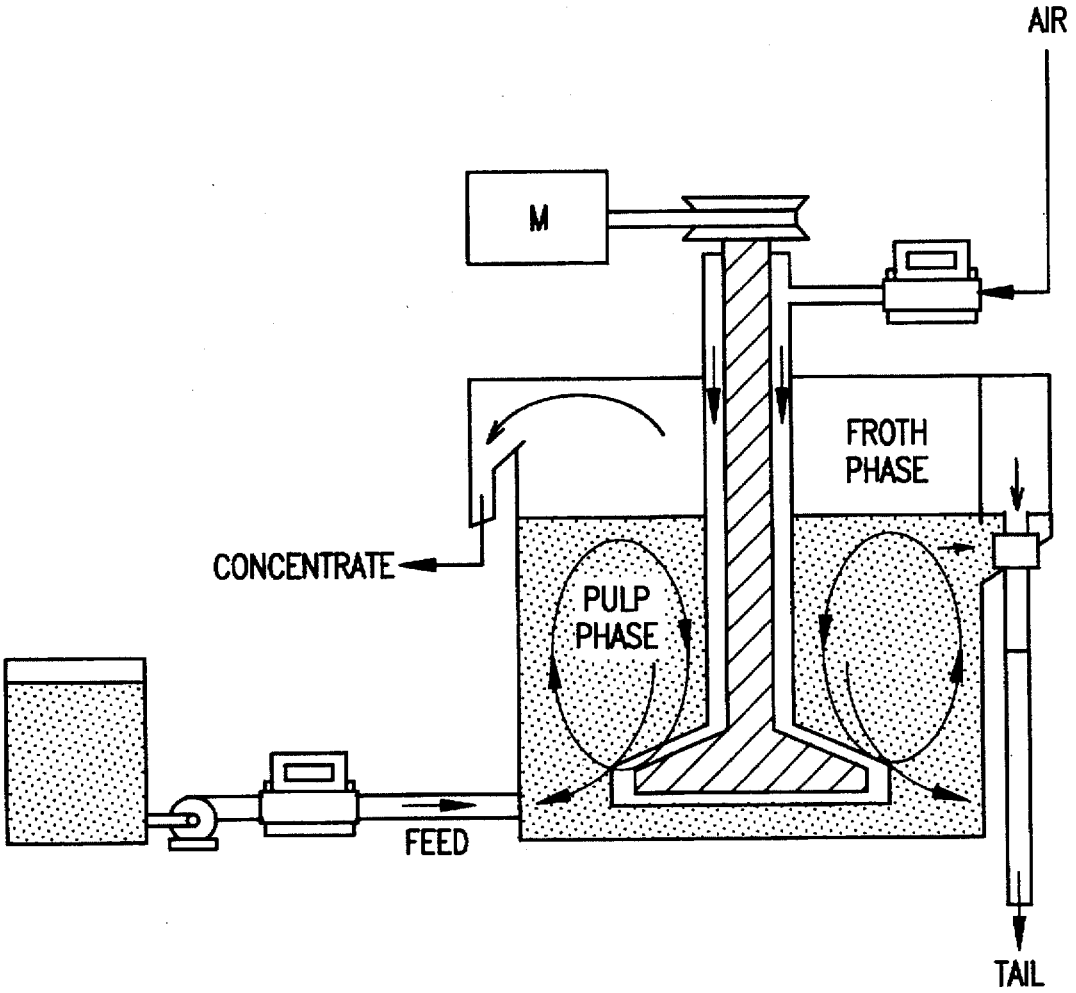
FIG. 1*a* shows a mechanically agitated flotation cell.

The conventional subaeration type mechanical cells of FIG. 1*a* and the conventional flotation column of FIG. 1*b* will first be described.

1. Conventional Mechanically Agitated Flotation Cell (FIG. 1*a*)

Although they differ in design and operation all conventional subaeration type flotation cells have common structural features. They consist of open-topped box for containing pulp, a rotary agitator at the bottom of the box, means to supply external air directly to the agitator, stators or means to confine agitation of the pulp to a zone directly around the agitator, a froth-overflow lip at the top of the box, and feed and discharge ports for pulp. Their common operative characteristic is that separation of concentrate from tailing is made in the column of bubbles maintained above the pulp in the box. Air is introduced in two ways. In one case the impeller acts as a centrifugal air pump submerged in the tank in which the hollow impeller shaft serves as the suction pipe. In the other case compressed air from external source is delivered to a point directly under the impeller. The action of the impeller breaks air into small bubbles and dispersed into the pulp. The feed mixture of mineral particles is normally introduced at one end of the flotation bank (series of cells) and the particles travel random paths due to the vigorous agitation before eventually exiting the cell on the opposite end of the feed inlet as tails or enter the froth as component of the concentrate. Therefore, the pulp becomes increasingly depleted in its content of floatable mineral particles as it progresses from the feed to the discharge end of flotation cell. Flotation cells of this type which employ turbulent agitation to effect air dispersion and bubble-particle collision suffer serious disadvantages. Particles may not become attached to a sufficient number of bubbles to form a bubble-particle aggregate of sufficient buoyancy to float to the surface by overcoming the force of turbulence. Particles residing in the froth zone may dislodge from the froth due to turbulent agitation. On the other side turbulent agitation is required for the particle-bubble contact and air dispersion. Due to these reasons scale-up of the equipment is unpredictable.

2. Conventional Flotation Column (FIG. 1*b*)

This type of cell is designed to overcome some of the difficulties associated with the mechanically agitated cells. They may differ in design and operation but have many common structural designs. They all are open-topped having heights several times their width and can be circular or rectangular cross-section. They have long bubble column at the top of the cell where separation of concentrate from tailing takes place. The feed is introduced to a point below the bubble-column. They have long pulp-column below the long bubble-column. The height of the bubble-column is maintained constant. Air is introduced externally to a point above the pulp outlet at the bottom. The aim-in air introduction is to have the bubbles that rise through the pulp under the bubble-column gently as small and, within limits, as numerous as possible.

The requirement for quiescent flow conditions is to avoid the detaching of particles from the bubbles and also to prevent the dislodging of particles from the froth phase experienced in the mechanically agitated cells due to vigorous mixing of pulp. However, due to lack of agitation, the particle-bubble collision (encounter) is not as efficient as in the mechanically agitated cell and hence the recovery is generally poorer but the quality of the product (concentrate grade) is much better. To further improve the grade, water is sprayed over the froth column to wash down the non-bubble attached gangue mineral particles. This has a side effect of further reduction in recovery because the washing action contributes to the dislodging of the floatable value minerals from the froth. If higher recovery is required then the cell has to be sufficiently larger to allow sufficient particle residence time. As in the case of the mechanically agitated cells the scale-up is not predictable.

Figure 1B:
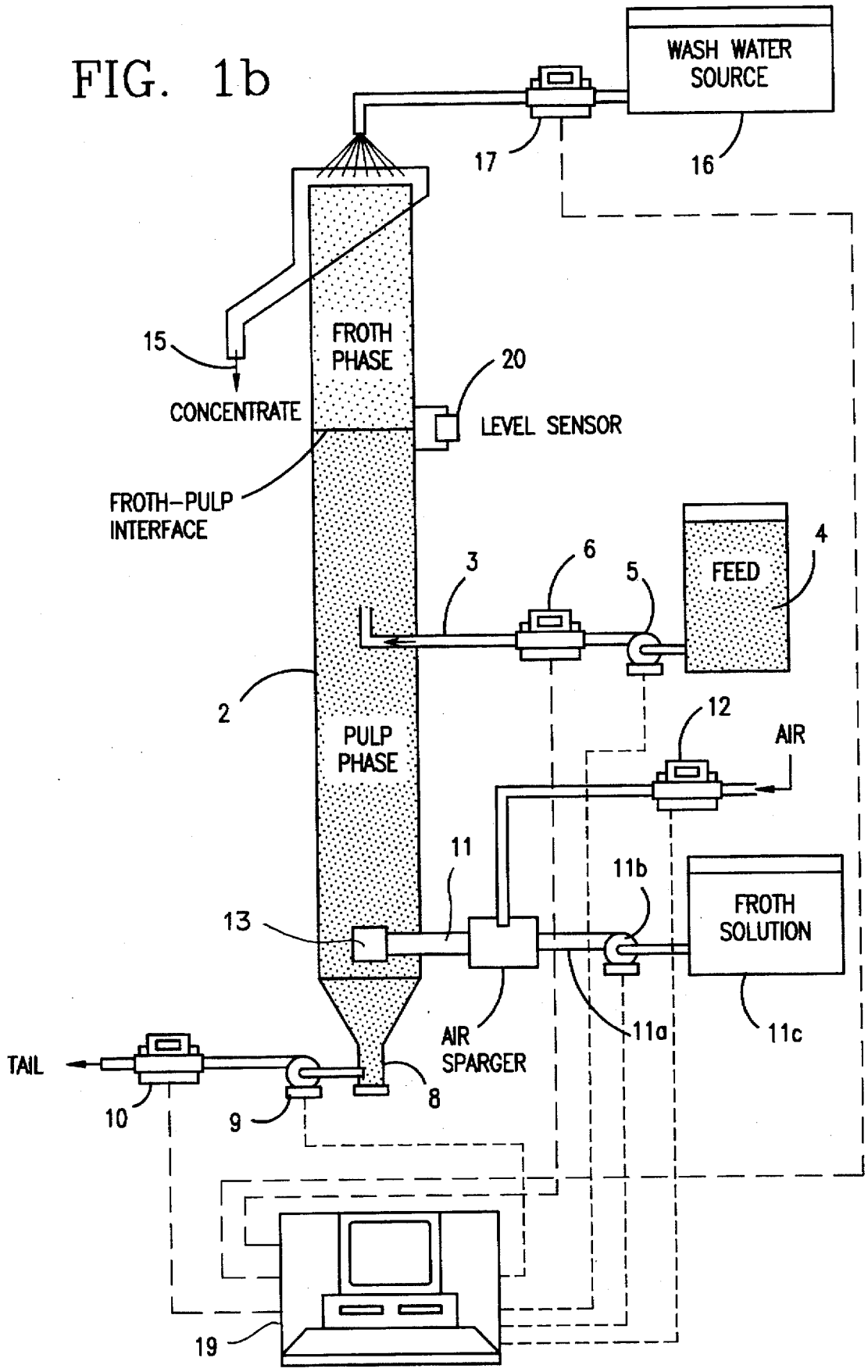
FIG. 1*b* shows a conventional flotation column and associated parts.

As FIG. 1*b* shows, the flotation column 2 has a first inlet 3 below the bubble-column for introducing a suspension of finely ground ore containing valuable and gangue minerals. This feed to the column is usually pre-concentrated using a mechanically agitated flotation cell which has a better recovery efficiency. Accordingly, the feed to the column has a higher ratio of the desired mineral than the original ore. The pulp is received from vessel 4 and, on its way to inlet 3, passes the flow meter 5 and control valve 6.

The column 2 has an outlet 8 at the bottom for tails discharge; the tails flow through a flow meter 9 and a control valve 10. A second inlet 11 connected to an air supply through control valve 12 is provided in the lower region of the column for introducing air. This inlet is connected to a sparger 13 which produces small micro-bubbles of air which rise in the column.

The main part of column 2 is the so-called "collection zone", and an upper portion provides a so called "froth zone" i.e., a zone comprising a mass of bubbles with little liquid. Bubbles attached to the concentrated ore particles leave the top of the froth zone and pass to an outlet 15. Wash water from source 16 is sprayed into the top of column 2. The flow is controlled by a flow indicating controller (FIC) 17.

This flotation column operates in the known manner which has already been described. The impingement of the wash water on the bubbles of the froth zone causes many bubbles to rupture and mineral particles to detach from bubbles and drop back to the pulp phase. These detached particles need to encounter more bubbles again being picked up. Fine gangue mineral particles are transferred to the froth zone in many ways—pushed up by on-coming bubbles, entrained in the water film enclosing the bubbles or by attachment to the bubbles (in the case of hydrophobic gangue minerals); these are mostly removed by washing in the froth zone but may re-attach to bubbles as they slowly descend through the length of the column.

The whole system is under the control of computer 19 connected to pumps 5, 9, 11*b* and flow controllers 6, 10, 12 and 17.

DETAILED DESCRIPTION OF THE INVENTION

Figure 2:
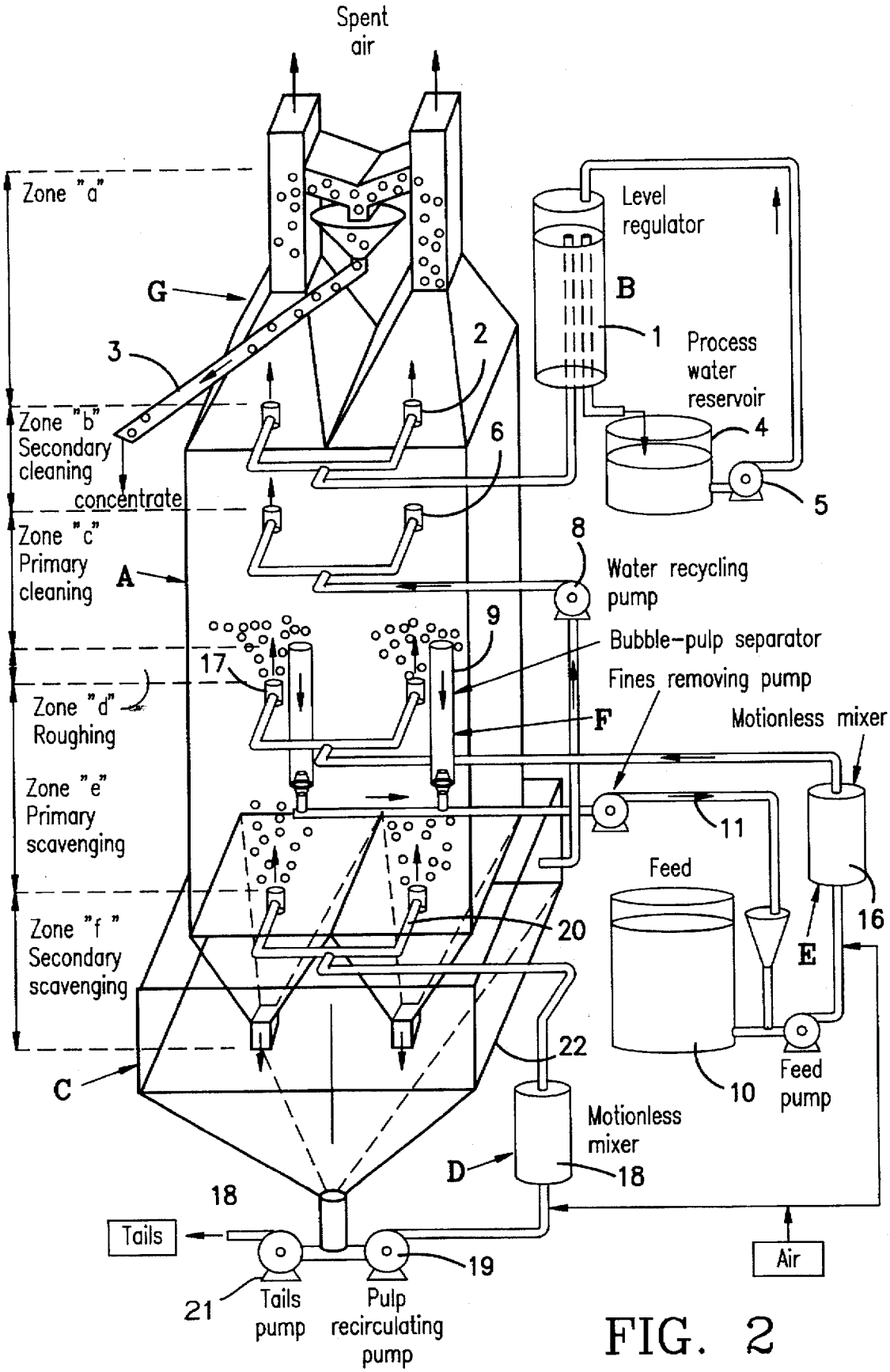
FIG. 2 shows the arrangement of the basic components of the new flotation cell in accordance with the invention.

FIG. 2 depicts an embodiment of the invention designed to overcome the shortcomings of prior art. The cell consists of six distinct zones, "a" to "f".

Zone "a" is characterized by an upward current and contains little or no fine gangue minerals. The flow of water from a level regulating tank 1 through outlets 2 near the top of the cell prevents recovery of feed water in the concentrate. The water level in the level regulating tank 1 is maintained at or above the level of the concentrate collection channel 3 to prevent the formation of froth at the top of the cell. A water reservoir 4 and a pump 5 supply water to the level regulating tank 1. As illustrated, the top of the cell or column is sealed with a cover "g" which is shaped in the form of a pair of inverted funnels, each having an outlet for ejection of spent air bubbles from the cell or column.

Zone "b" is consists of clean process water flowing counter-current to the bubbles at a rate equal to the sum of the volume of concentrate being removed and the bias (when allowed). The water supplied to this secondary cleaning zone through outlets 6 is recycled from water supernatant to the tails at the bottom of the cell. A photosensor 7 (see FIG. 3) may be used to fix a turbidity limit to this recycled water by controlling the water recycling pump 8.

Zone "c" is the primary cleaning zone. The downward flow of water in this zone is greater than-that in zone "b" by the amount recycled from the bottom of the cell into zone "b". Pulp entering this zone by trailing the bubbles is decelerated and further purified by operation of bubble-pulp separators 9. The current flow in the vicinity of a bubble-pulp separator is shown with arrows in FIG. 2*a*. The circulation of pulp through the bubble-pulp separators enhances the purity of the flotated ore. It is believed that pressure differentials cause the current flow pattern shown in FIG. 2*a*.

Figure 2A:
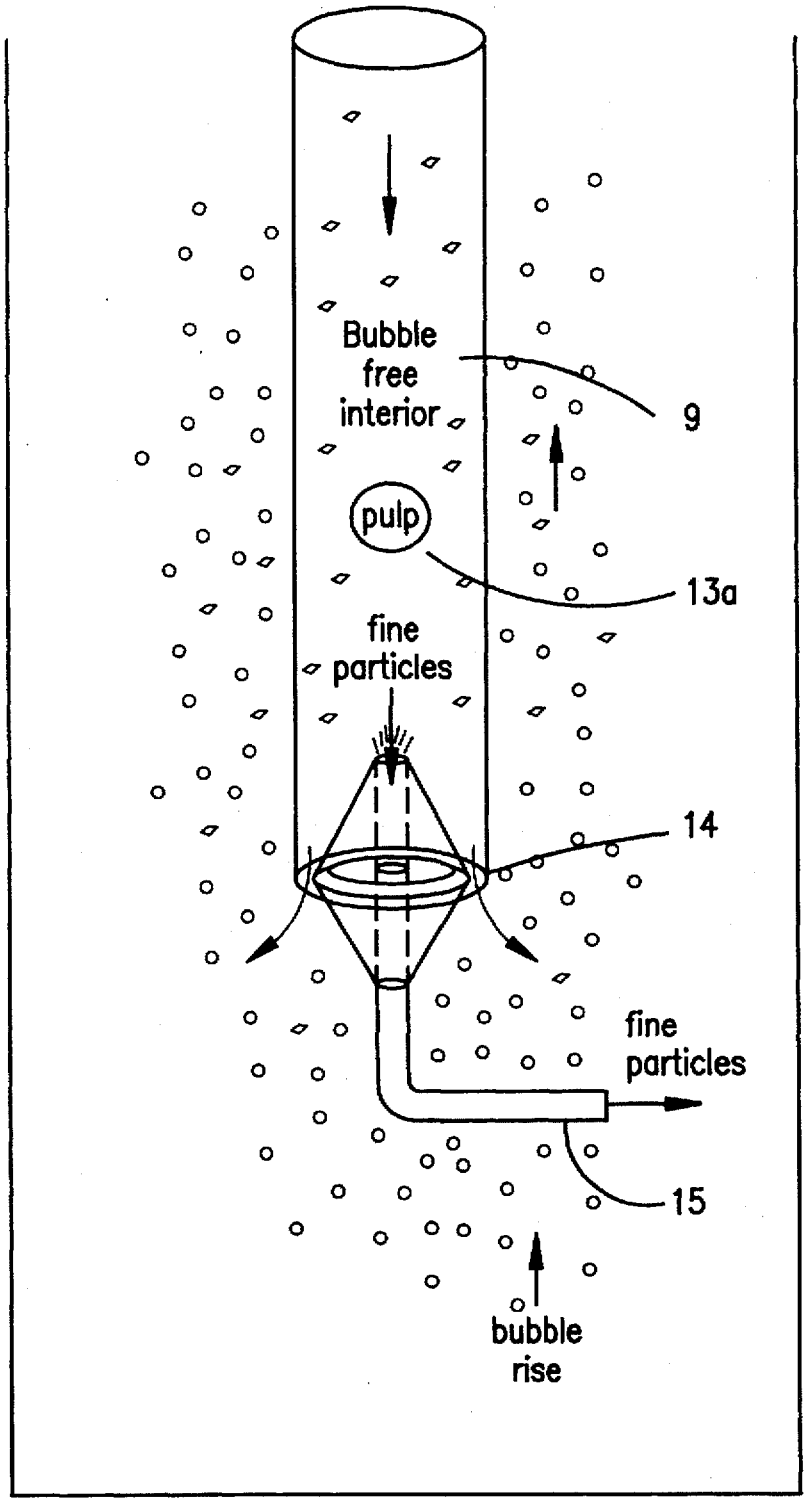
FIG. 2*a* shows the mechanism used to circulate pulp (pulp/bubble separator).

One embodiment of a bubble-pulp separator is shown in FIG. 2*a*. A housing 13*a* is mounted above a bi-conical piece 13 to provide a narrow slot 14. This bi-conical piece allows water to flow out through the bottom of the bubble-pulp separator but prevents rising bubbles from entering. In one embodiment, an axial outlet 15 through the bi-conical piece leads to recycling conduit 11 (or 12).

Figure 3:
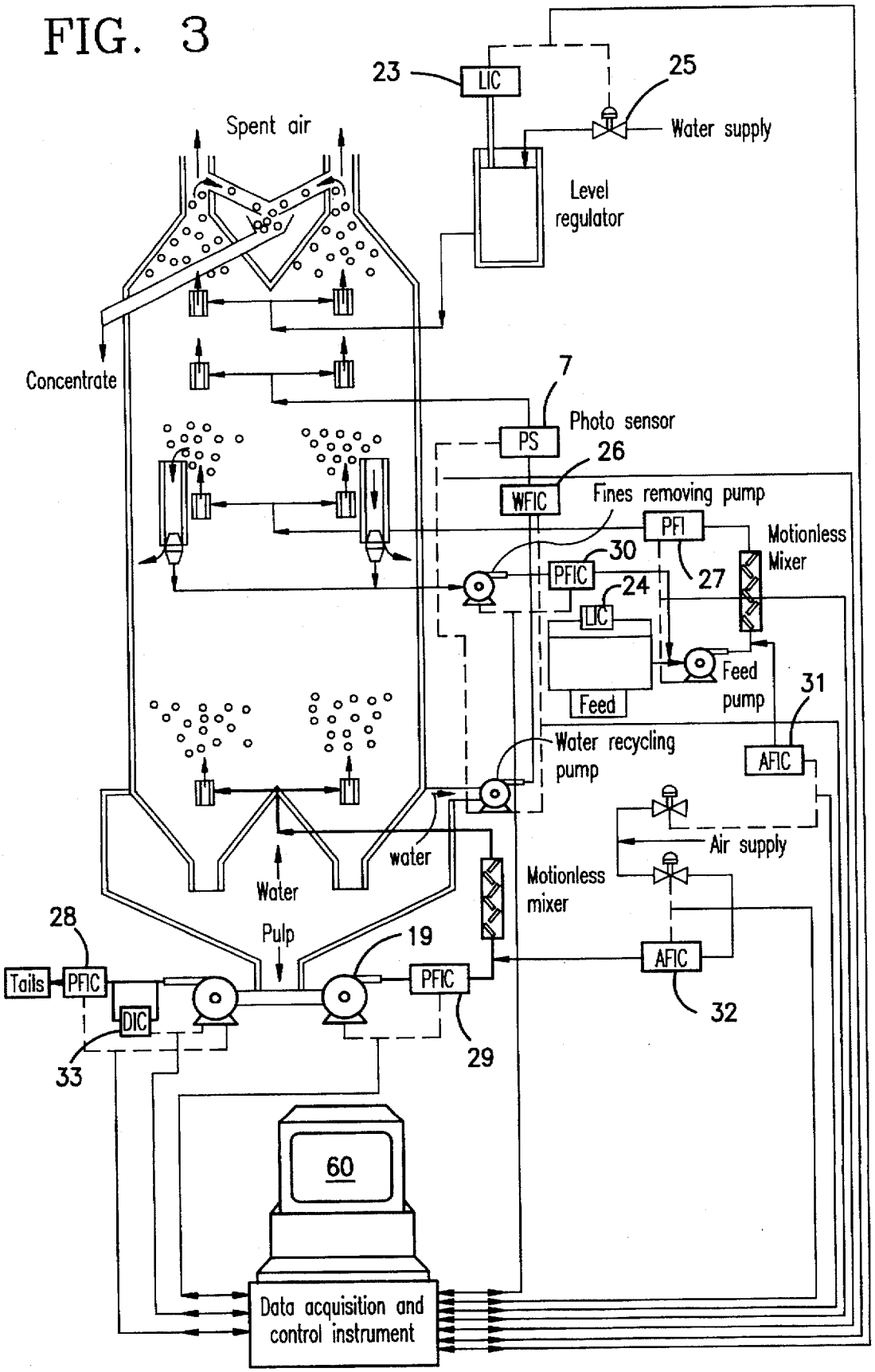
FIG. 3 shows a modified version of the flotation column shown in FIG. 2.
Figure 4:
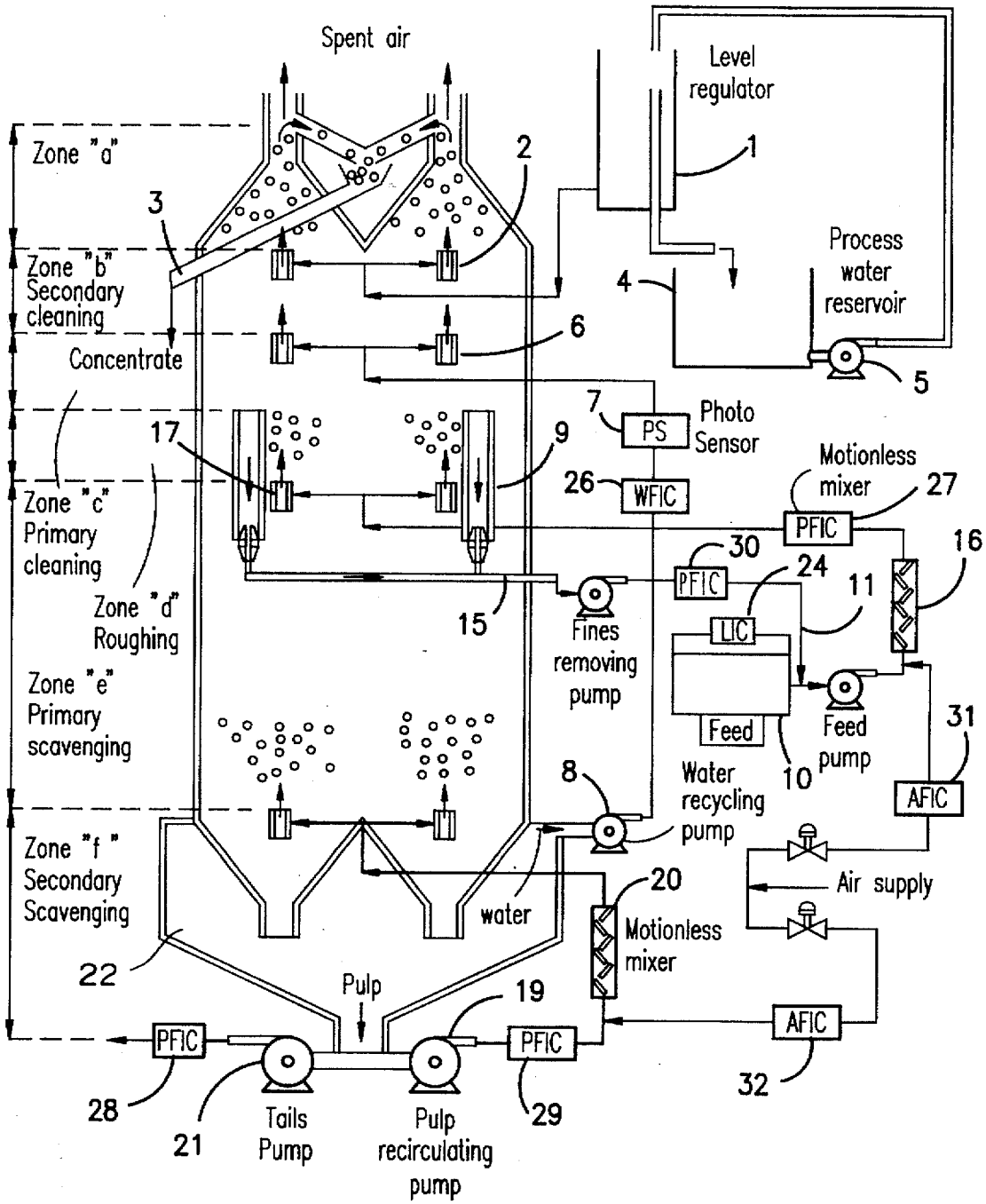
FIG. 4 shows a modified version of FIG. 2 representing the operation of the equipment with minimum instrumentation (manual control).

In the embodiments of the invention depicted in FIGS. 2, 3, and 4, the bubble-pulp separators are adapted to recycle the pulp to the top of zone "e". This may be done either by pumping this pulp water back to the feed tank 10 through a recycling tube 11 or directly through tube 12. (shown in broken lines). A stop-cock (not shown) may be used to select the route of the recycled pulp water.

Zone "d", the roughing zone, has a complicated flow pattern. Whether the flow is co-current or counter-current to the bubbles depends on the flow of pulp trapped and separated from the bubbles in zone "c". If this flow is less than the sum of the volume of concentrate being removed, the volume of water recycled, and the allowance for bias, then there is a counter-current flow at a rate equal to the difference. Otherwise, the flow is co-current and will boost the lifting of the bubbles as soon as they enter the cell with the feed. Pulp from the feed tank is mixed with air in a motionless mixer 16 and pumped into the cell through inlet conduits 17.

Zone "e" is a region of intense agitation effected by the recycling of tails with air in a second motionless mixer 18. Recycled tails are pumped into zone "e" by recirculating pump 19 through conduits 20. Zone "e" is the primary scavaging zone.

Zone "f", the secondary scavaging zone, is a dead region located below baffle in-flow zones "e" and "d". Tails are removed and recycled from this zone by tail pump 21 and pulp recycling pump 19. The recycled pulp is mixed with air in motionless mixer 18 and reintroduced to primary scavaging zone "e" through conduit 20. Water supernatant to the tails 22 is recycled as described above (zone "b").

FIG. 3 depicts an embodiment of the invention adapted for automation of the flotation process. Data acquisition and control may be performed using an industrial grade PC and a commercial software package (FIX DMACS GVI). Flow rates for all pumps is adjusted in response to feedback from level indicating controllers 23 and 24, water flow indicating controllers 25 and 26, pulp flow indicating controllers 27, 28, 29, and 30 air flow indicating controllers 31 and 32, density indicating controller 33 and photosensor 7. FIG. 4 depicts an embodiment adapted for manual control of the flotation process.

Figure 5:
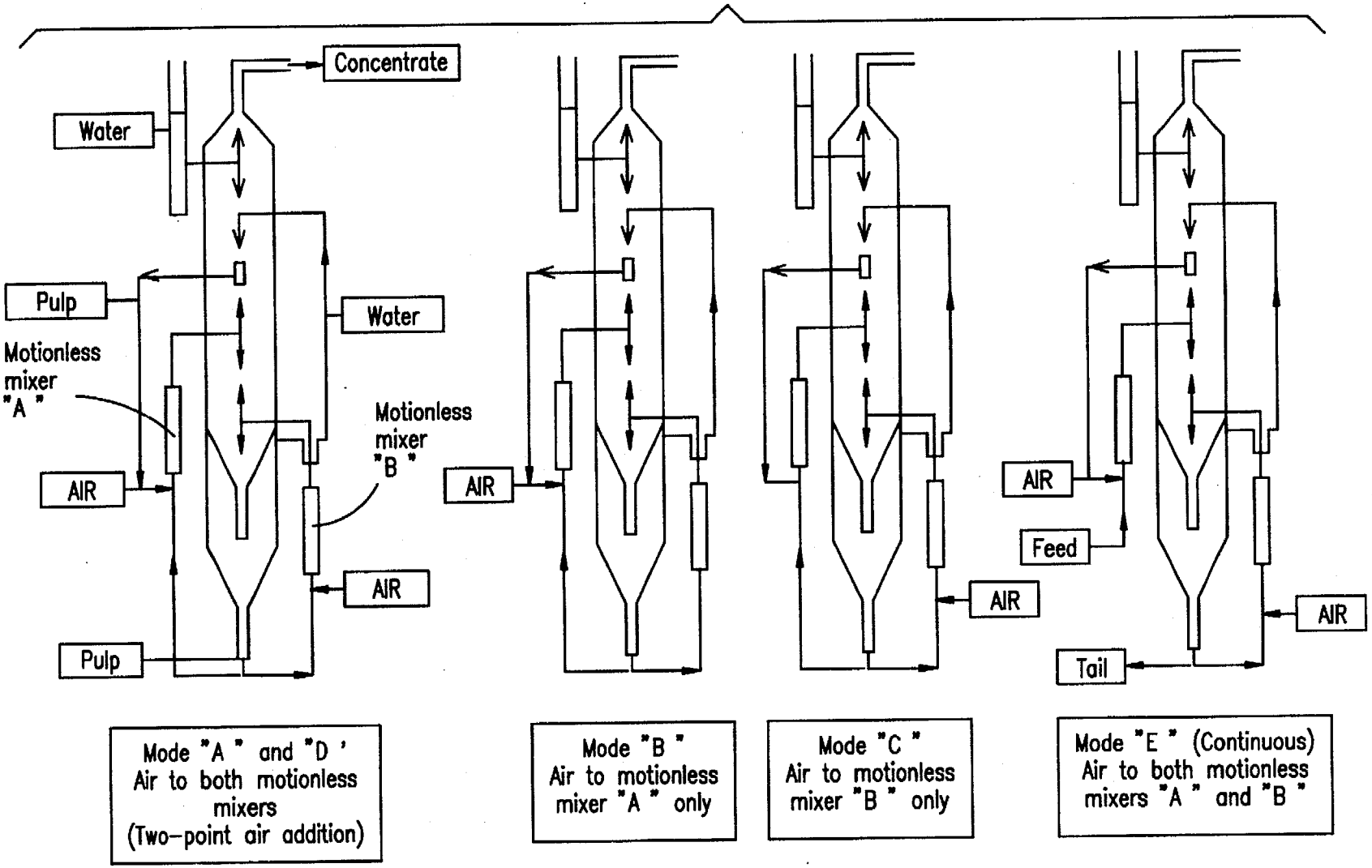
FIG. 5 shows four operational modes of the invention.

The performances of various embodiments of the invention (depicted in FIG. 5) were investigated. The following operating nodes were selected:

Mode A, conditions of two-point air addition to the cell, semi-continuous.

Mode B, one-point-only air addition via feed stream, semi-continuous.

Mode C, one-point-only addition via bottom mixing stream, semi-continuous.

Mode D, high % solids with two-points air feed, semi-continuous.

Mode E, two-point air addition, continuous.

Tests were conducted mainly at 22% solids, although two of them were conducted at 43% solids, with air being introduced through both mixers.

Figure 5A:
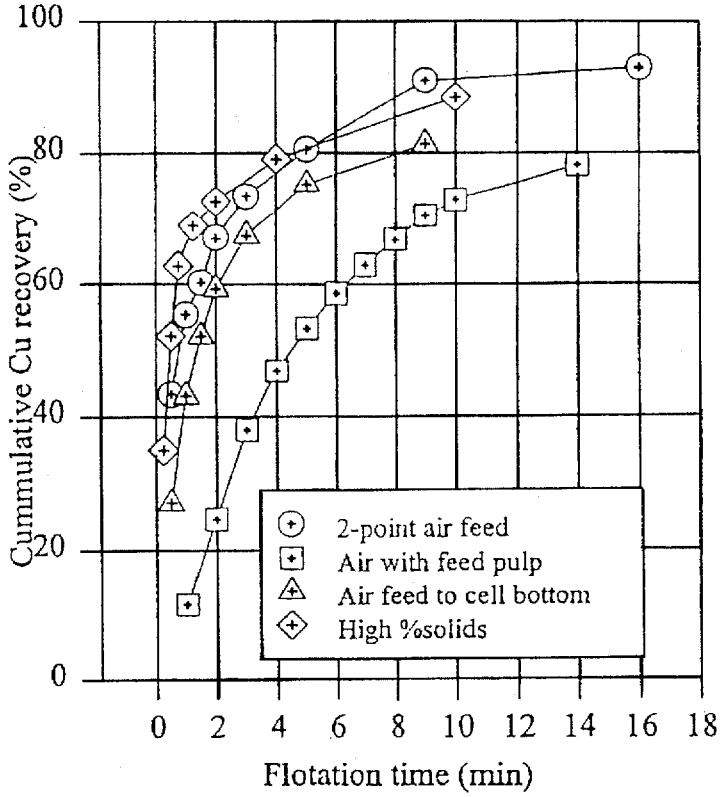
FIG. 5*a* graphically represents flotation rates of pulp containing Cu for different operational modes.
Figure 5B:
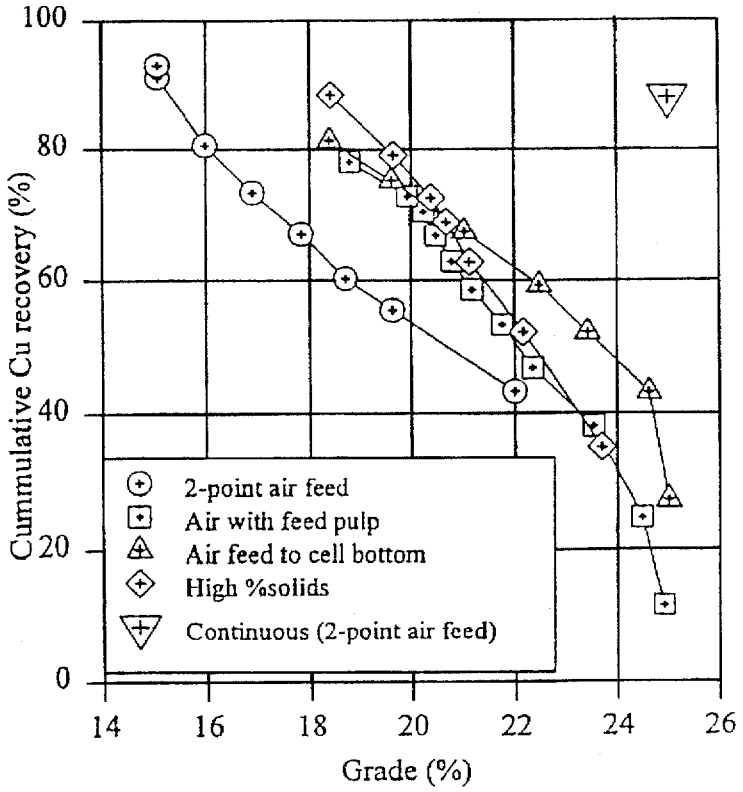
FIG. 5*b* graphically represents grade-recovery variation for different operational modes.
Figure 5C:
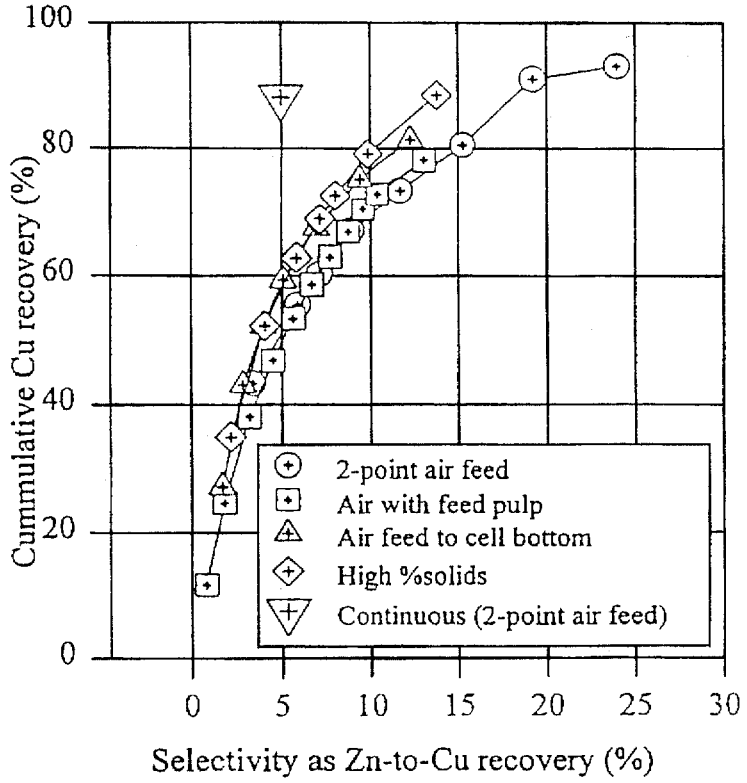
FIG. 5*c* graphical representation of Cu/Zn selectivity for different operational modes.

FIGS. 5*a*, 5*b*, and 5*c* show the effects of various operating modes on the flotation rate, recovery, grade and selectivity. The contribution of each of the air feeding modes can be evaluated from Table I, which contains some information extracted from FIGS. 5*a*, 5*b*, and 5*c*. $G_{50}$ and $G_{80}$ denote grade of the float at 50% and 80% Cu recovery respectively. $t_{50}$ and $t_{80}$ are the corresponding flotation times required for such a recovery.

TABLE I

Comparison of various operating modes based on concentrate grade at 50% and 80% Cu recoveries

| Mode | Air to feed (L/min) | Air to cell (L/min) | Grade at 50% recovery, "$G_{50}$" (%) | $t_{50}$ (min) | Selectivity Zn-to-Cu Recovery (%) | Grade at 80% recovery, "$G_{80}$" (%) | $t_{80}$ (min) | Selectivity Zn-to-Cu Recovery (%) |
|---|---|---|---|---|---|---|---|---|
| A | 1.5 | 2 | 20.5 | 0.4 | 7.5 | 16.0 | 4.8 | 15.0 |
| B | 1.5 | 0 | 22.2 | 4.5 | 6.5 | 18.2 | 16.0 | 14.5 |
| C | 0.0 | 2 | 23.7 | 1.6 | 4.0 | 18.5 | 8.4 | 12.5 |
| D | 2.0 | 3 | 22.4 | 0.5 | 4.0 | 19.3 | 4.5 | 10.2 |
| E | 1.5 | 2 | | | | 26.0 | | 5.0 |

In Mode A test, $G_{80}$ and $G_{50}$ are 16% Cu and 20.5% Cu respectively. The $G_{50}$ recovery at this rather good grade was obtained at $t_{50}$ of 0.5 min. Better $G_{50}$ (22.4% Cu) was produced at similar $t_{50}$ of 0.5 min when the test was conducted in Mode D, a high % solids pulp (43% solids). Mode A was conducted at 22% solids. At similar $t_{80}$ of 4.5 min a much better $G_{80}$ of 19.3% Cu was obtained with the denser pulp. At $t_{50}$ of 0.5 min a $C_{50}$ of 22.4% was achieved, at least 2 percentage points more than the less dense pulp. The test conditions, however, were slightly different in that an overall air feed of 5 L/min instead of 3.5 L/min was used in Mode D test. In a conventional froth flotation system increased air rate would result in concentrate grade deterioration, which is the opposite of what has been observed here. The recovery of Zn-to-Cu which would normally increase with increased pulp density and air rate has been, in fact, reduced both at $G_{80}$ and $G_{50}$, from 7.5% to 4% and from 15% to 10% respectively. It is clear that at optimized conditions, the process is capable of superior results considering that this is a very problematic ore, and that never before has a rougher grade higher than 12% at lover than 34% Zn recovery been achieved.

Figure 6A:
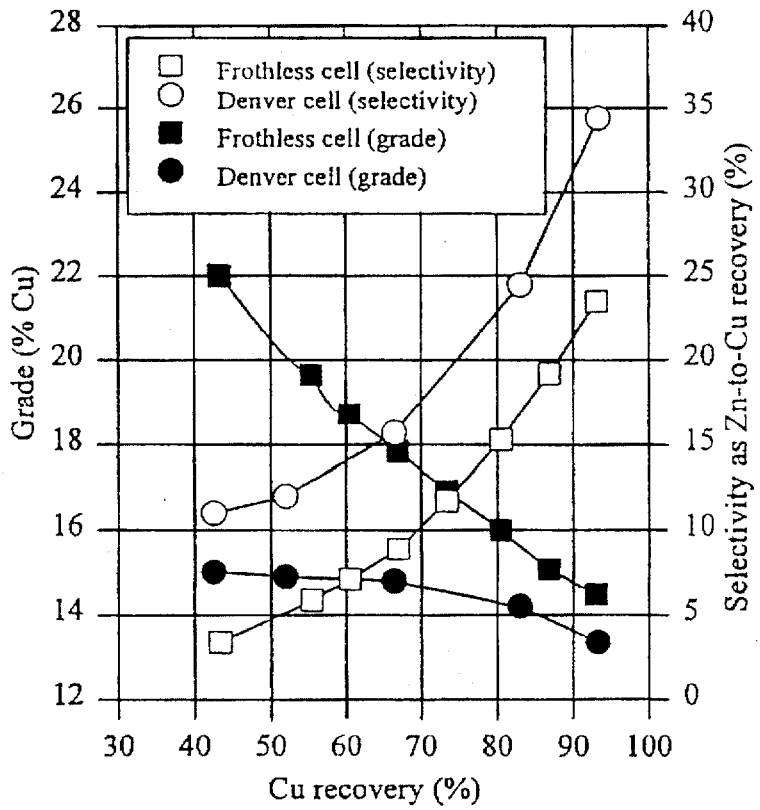
FIG. 6*a* a graphical comparison of the performances of the frothless cell of the invention and the Denver cell based on grade-recovery-selectivity.
Figure 6B:
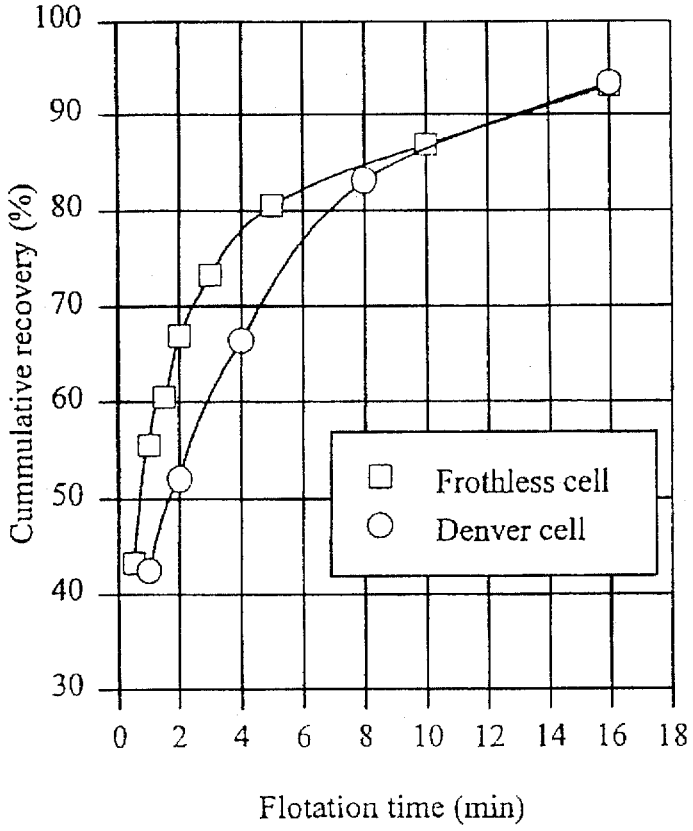
FIG. 6*b* a graphical comparison of the performances of the frothless cell of the invention and the Denver cell based on Cu recovery rate.

93% Cu was recovered at 14.5% concentrate grade after 10 minutes of flotation in Mode A testing. The recovery of Zn-to-Cu in that test was only 24% (see FIG. 5*c*). A comparison of this test with the best Denver cell batch test, with all factors optimized, indicates that the frothless cell performs better than the Denver cell in all aspects (see FIG. 6*a* and FIG. 6*b*). Note that at similar Cu recovery of 93%, the frothless cell recovered 10 percentage points less Zn. The Denver cell recovered 34% Zn. The $G_{50}$ value for the frothless cell is 20.5% Cu compared to 15% for the conventional flotation. Less than half as much Zn was recovered into the concentrate with the frothless cell in about the same flotation time. Since pulp chemistry conditions were kept as constant as possible, 10 percentage point higher Zn recovered by the Denver cell at 93% Cu recovery is most likely not due to true flotation, but rather to entrainment, an effect which the frothless cell effectively suppresses. A significant difference between the two cells is the concentrate recovery rate, even though the same overall air rate of 3.5 L/min was used in each case. At rates up to 67% Cu recovery, the time required to recover one unit by the Denver cell is three times that of the frothless cell. 93% recovery is attained in 10 minutes using the frothless cell, whereas the Denver cell required 16 minutes to attain a similar recovery. Although it is possible to double or even triple the air flow in the frothless cell (by controlling bubble size by various designs and sizes of the mixing elements of the motionless mixer) to enhance the recovery rate even further, it was not possible to increase the air flow in the 3 L Denver cell beyond 5 L/min without causing serious mixing in the froth phase. Whether air is fed only via feed stream or to the bottom of the cell, the grade/recovery characteristics of the float remained similar for Cu. Selectivity also remains similar. The major difference is in the flotation rate which is partly due to the low air rate used when it is introduced via the feed mixer. Should this rate be increased to at least 2 L/min (as in case D) comparable flotation rate would have been obtained.

The last operating mode tested in the series was a continuous feeding of pulp at 3.0 L/min (at 43% solids). Despite the increase in the percent solids, the same air rates as in Mode A were maintained. This test provided the best Cu grade, 25% Cu at 85% recovery, while recovering only 5% of the Zn. This amount of Zn may be mineralogically associated with chalcopyrite or could be contained by floatable sphalerite that does not require activation. It is expected that with an increased air rate (similar to the amount used in Mode D), the recovery of Cu would be enhanced with no substantial change in concentrate grade. A Zn flotation test was conducted in the air-to-feed only mode, following the flotation of Cu with air-to-cell only mode. 65% of contained Zn was recovered at 53% Zn grade confirming the high separation efficiency of the invention.

Figure 7:
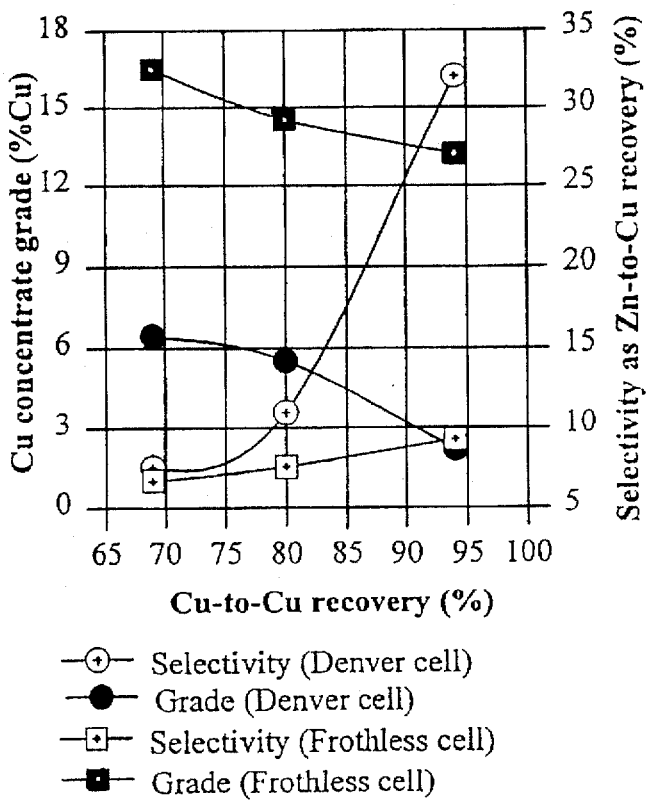
FIG. 7 a graphical comparison of the performances of the frothless cell of the invention and the Denver cell during low grade Cu ore flotation.
Figure 8:
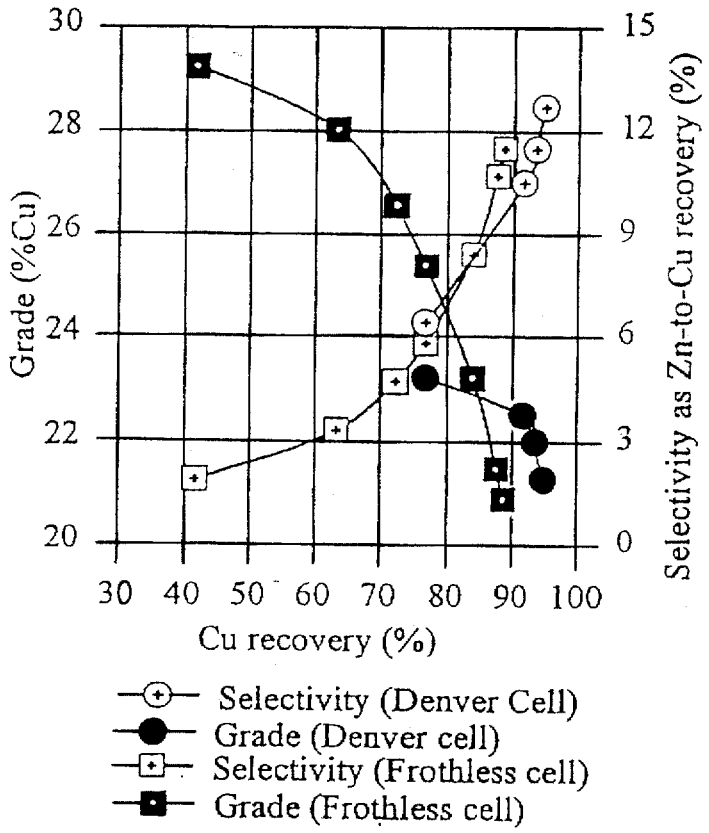
FIG. 8 a graphical comparison of the performances of the frothless cell of the invention and the Denver cell for easy-to-treat Cu—Zn ore.

FIG. 7 is a comparison of the performance of the frothless cell with that of the conventional cell,—this time testing selective flotation of a high-iron/low-Copper (18% Fe, 0.67% Cu) pyritic Cu-Zn ore, containing 2.2% Zn, from Les mines Selbaie. Even though the flotation pulp chemistry was not optimized, only 5% Zn was recovered by the frothless cell whereas 31% of the Zn in the feed reported to Cu concentrate produced by the Denver cell (at 94% Cu recovery). The concentration-ratio of Cu for the frothless cell is 20.9 compared to only 3 for the mechanical cell. This big difference is due to the requirement to grind the ore to finer than 80% passing 37 μm for good Cu-Zn separation. At this grinding the ore becomes slimy and this contaminates the froth. The absence of froth and the internal cleaning mechanisms of the frothless cell successfully prevent such concentrate contamination by entrainment. FIG. 8 is a similar comparison, but for a relatively easy-to-treat Cu--Zn ore from Kidd Creek. It is obvious that the improvement of metallurgy by using the frothless cell is not as spectacular as in the other cases. However, it is worthwhile noting that a final grade cu concentrate is obtained.

The following summarizes the most important findings of the tests:

- introducing flotation pulp to the flotation cell in the form of a three-phase suspension has the advantage of improving flotation rate. This can be achieved using motionless mixers. Use of complicated reactor-type three-phase dispersing mechanism could also be used, but the more simple motionless mixers could do similar job. They are cheaper, maintenance-free, and do not require additional water or frother unlike conventional spargers. Motionless mixers force floatable particles into intimate contact with bubbles under intense pressure. Therefore, the bubble-particle contact time, bubble film thinning, rupture, and attachment are almost instantaneous events, which is not the case in the mechanically agitated flotation cells and columns.
- the flotation rate can further be enhanced by eliminating the rate determining phase in froth flotation, the froth phase itself.
- the concentrate grade and selectivity can be enhanced, without affecting mineral recovery by eliminating the recovery of feed water to the concentrate.
- froth flotation without actual formation of froth phase is a reliable technique for flotation enhancement which presents a wide range of operational flexibility and ease of process control to achieve best metallurgical results.

The embodiments of the invention in which an exclusive property or privilege is claimed are defined as follows:

1. An apparatus for selective concentration by frothless flotation of minerals in an ore from an aqueous pulp containing said ore comprising:

(a) a flotation column having an upper, a middle and a lower region;

(b) a cover sealingly engaged to the top edge of the upper region of the column, said cover having a first outlet comprising a first conduit to allow aqueous suspension to exit from the top of the apparatus;

(c) a second conduit extending between a feeding tank containing said aqueous pulp and a first inlet located in the middle or upper region of the column for introducing said aqueous pulp wherein said second conduit includes a stationary mixer and a means of introducing a gas into said aqueous pulp;

(d) a third conduit extending from the tails at the bottom of the cell to the top of the lower region or the lower part of the middle region, wherein said third conduit includes a pump, a stationary mixer and a means to introduce a gas into the tails;

(e) a second outlet at the bottom of the lower region of the column for removing the tails;

(f) a fourth conduit extending from the upper part of the lower region of the column to the upper region of the column wherein said fourth conduit includes a pump and a photosensor;

(g) a wash-water chamber in communication with the upper region of the column above said first inlet wherein the water level in said wash-water chamber is maintained at or above the uppermost part of said cover; and (h) moans to recycle the pulp comprising walled housings mounted above separate members to provide bubble-pulp separators having upper openings and lower slit openings wherein said separate members are shaped and situated below said housings in such a way that downward flowing aqueous suspension can flow out the lower slit openings but upwardly moving bubbles cannot enter the housings through the lower slit openings.

2. The apparatus of claim 1 which includes a fifth conduit extending from said bubble-pulp separators to said feed-tank containing said aqueous pulp wherein said fifth conduit includes a pump.

3. The apparatus of claim 1 which includes a computer adapted to monitor and regulate the flow of aqueous suspension in the column.

4. The apparatus of claim 1, wherein said cover has an inverted funnel shape with said first outlet disposed at a top end thereof.

5. The apparatus of claim 1, further including means for recycling the tails.

6. The apparatus of claim 5, wherein said means for recycling the tails comprises a pump having an inlet connected to said second outlet, and a pump outlet connected through a conduit to said column.

7. The apparatus of claim 6, wherein said conduit includes a mixer with means for introducing a gas.

8. The apparatus of claim 1, further including means for recycling wash water from a lower portion of said column to an upper portion of said column.

9. An apparatus for selective concentration by frothless flotation of minerals in an ore from an aqueous pulp containing said ore comprising:

(a) a flotation column having a top end and a bottom end;

(b) a cover sealingly engaged to said top end of said column, said cover having a first outlet for allowing aqueous suspension to exit from a top of the apparatus;

(c) means for introducing aqueous pulp into said column;

(d) means for introducing air bubbles into said column; and (e) at least a first bubble-pulp separator suspended in said column, said bubble-pulp separator including:

1) an annular slot for allowing aqueous suspension to float downward through said separator, but preventing bubbles from passing upwardly through said separator; and 2) an axial outlet for directing downwardly flowing aqueous pulp out of said column to be recycled.

10. The apparatus of claim 9, wherein said cover has an inverted funnel shape with said first outlet disposed at a top end thereof.

11. The apparatus of claim 9, further including:

(f) a second outlet at said bottom end of said column for removing aqueous pulp from said column; and (g) means for recycling pulp from said second outlet to an inlet disposed in said column.

12. The apparatus of claim 11, wherein said means for recycling said aqueous pulp comprises a pump having an inlet connected to said second outlet, and a pump outlet connected through a conduit to said inlet in said column.

13. The apparatus of claim 12, wherein said conduit includes a mixer with means for introducing a gas.

14. The apparatus of claim 9, further including means for recycling wash water from a lower portion of said column to an upper portion of said column.

* * * * *